US005144386A

United States Patent [19]

Matsuo et al.

[11] Patent Number: 5,144,386

[45] Date of Patent: Sep. 1, 1992

[54] IMAGE-FORMING APPARATUS HAVING A MANUAL PAPER SUPPLY PORT LOCATED ABOVE A PAPER DISCHARGING PORT

[75] Inventors: Takeshi Matsuo, Higashi-Osaka; Mitsutoshi Takemoto, Yao, both of Japan

[73] Assignee: Mita Industrial Co., Ltd., Osaka, Japan

[21] Appl. No.: 668,255

[22] Filed: Mar. 12, 1991

[30] Foreign Application Priority Data

Mar. 19, 1990 [JP] Japan ..... 2-70806
Mar. 19, 1990 [JP] Japan ..... 2-70808
Jul. 10, 1990 [JP] Japan ..... 2-183452

[51] Int. Cl.[5] ..... G03G 21/00
[52] U.S. Cl. ..... 355/321; 355/309
[58] Field of Search ..... 355/308–311, 355/316, 317, 321, 322, 318, 72; 271/3, 212; 226/118

[56] References Cited

U.S. PATENT DOCUMENTS 4,541,710 9/1985 McLeish ..... 355/310
4,959,685 9/1990 Kato ..... 355/72
4,961,090 10/1990 Gray, Jr. et al. ..... 355/309 X
4,996,556 2/1991 Gray, Jr. ..... 355/311 X
5,012,297 4/1991 Yamashita et al. ..... 355/321
5,028,965 7/1991 Kinoshita et al. ..... 355/318 X

*Primary Examiner*—A. T. Grimley
*Assistant Examiner*—William J. Royer
*Attorney, Agent, or Firm*—Wenderoth, Lind & Ponack

[57] ABSTRACT

In order to stack papers discharged from a paper discharging port provided above a manual paper supply port so that they may be easily removed from the front of an image-forming apparatus, a paper discharging passage extending in the up and down direction for moving the paper discharged from the paper discharging port around the front of the body of the image-forming apparatus to guide it downward and a paper discharging tray extending over the internal space of a deck below the paper discharging passage are provided. In order to easily conduct the mounting and removal of the paper discharging tray and the assembly of the image-forming apparatus, the paper discharging tray is mounted on a rolled paper supply unit provided in front of the body of the image-forming apparatus. In addition, in order to prevent a phenomenon wherein the corner portions on both sides of the paper are bent when it is supplied and the phenomenon wherein the paper is resupplied when it is being discharged form the paper discharging port above the manual paper supply port from occurring, a paper supply and discharging guide is provided between the manual paper supply port and the paper discharging port.

25 Claims, 10 Drawing Sheets

IMAGE-FORMING APPARATUS HAVING A MANUAL PAPER SUPPLY PORT LOCATED ABOVE A PAPER DISCHARGING PORT

BACKGROUND OF THE INVENTION

1. Field of the Invention

The present invention relates to an image-forming apparatus in an electrostatic photographic copying machine, a facsimile machine and the like.

2. State of the Prior Art

A conventional image-forming apparatus, in which a paper discharging port is formed above a manual paper supply port, is adapted to receive a paper discharged from the paper discharging port in a rolled-up form. Accordingly, the paper has been unable to stack so as to be easily taken out from the front of the apparatus.

In addition, in the image-forming apparatus in which a paper discharging port is formed above a manual paper supply port, there has been the possibility that if a paper is curled, the curled portion of the paper is brought into contact with an upper edge of the manual paper supply port when the paper supplied is bent. A curled portion may also reenter the manual paper supply port below the paper discharging port when the transfer paper is discharged from the paper discharging port, after the formation of an image, thus being fed through the machine again.

SUMMARY OF THE INVENTION

The present invention has been achieved in view of the above drawbacks of the prior art, and it is an object of the present invention to provide an image-forming apparatus in which a paper discharging port is formed above a manual paper supply port and which is capable of stacking paper discharged from the paper discharging port so as to be easily removed from the front of the apparatus.

It is another object of the present invention to provide an image-forming apparatus in which a paper discharging port is formed above a manual paper supply port, provided with a rolled paper supply unit in front thereof for supplying the manual paper supply port with rolled paper, and capable of easily mounting and removing a paper discharging tray stacking the paper discharged from the paper discharging port and assembling the image-forming apparatus.

It is a further object of the present invention to provide an image-forming apparatus in which a paper discharging port is formed above a manual paper supply port, capable of preventing corner portions on both sides of a paper from being bent when the paper is supplied and a phenomenon of resupplying the paper from occurring when the paper is discharged from the paper discharging port above the manual paper supply port by a simple construction.

In order to achieve the above described objects in the present invention, the following construction is adopted.

That is to say, an image-forming apparatus comprises a body provided with a paper discharging port above a manual paper supply port. A deck has the body of the image-forming apparatus mounted thereon, and a paper discharging passage extends in the up and down direction for making a paper discharged from the paper discharging port go around the front of the body of the image-forming apparatus to guide it downward. A paper-discharging tray extends over the internal space of the deck below the paper discharging passage.

According to this construction, the paper discharged from the paper discharging port of the body of image-forming apparatus goes around the front of the body of image-forming apparatus via the paper discharging passage to be guided downward, whereby it is put in the paper discharging tray one upon the other, to be stacked.

According to a further feature of the invention, an image-forming apparatus is provided with a paper discharging port formed above a manual paper supply port. A rolled paper supply unit is in front of the body of the image-forming apparatus for supplying the manual paper supply port with a rolled paper. A paper discharging tray is mounted on the rolled paper supply unit for stacking papers discharged from the paper discharging port.

According to this construction, since the rolled paper supply unit is provided with the paper discharging tray mounted thereon, the rolled paper supply unit can be connected with the body of image forming apparatus while the paper discharging tray can be removed after the removal of the rolled paper supply unit from the body of image-forming apparatus.

According to yet a further feature of the invention, the body of the image-forming apparatus is provided with a paper discharging port formed above a manual paper supply port and a plurality of paper supply and discharging guides having a lower surface portion formed as a paper supply guide portion and an upper surface portion formed as a paper discharging guide portion at intervals in the direction of the width of the apparatus between the manual paper supply port and the paper discharging port.

According to this construction, since the paper supply and discharging guides are provided between the manual paper supply port and the paper discharging port, even where corner portions on both sides of a pointed end of a paper are curled upward, the paper can be surely guided to the inside of the manual paper supply port by the lower surface portions of the paper supply and discharging guides, i.e. the paper supply guide portions. The portions on both sides of the paper discharged from the paper discharging port are guided by the upper surface portions of the paper supply and discharging guides, i.e. the paper discharging guide portions, to prevent the paper from reentering the manual paper supply port, i.e. supplying the paper supply port with the transfer paper again.

DESCRIPTION OF THE PREFERRED EMBODIMENTS

Figure 1:
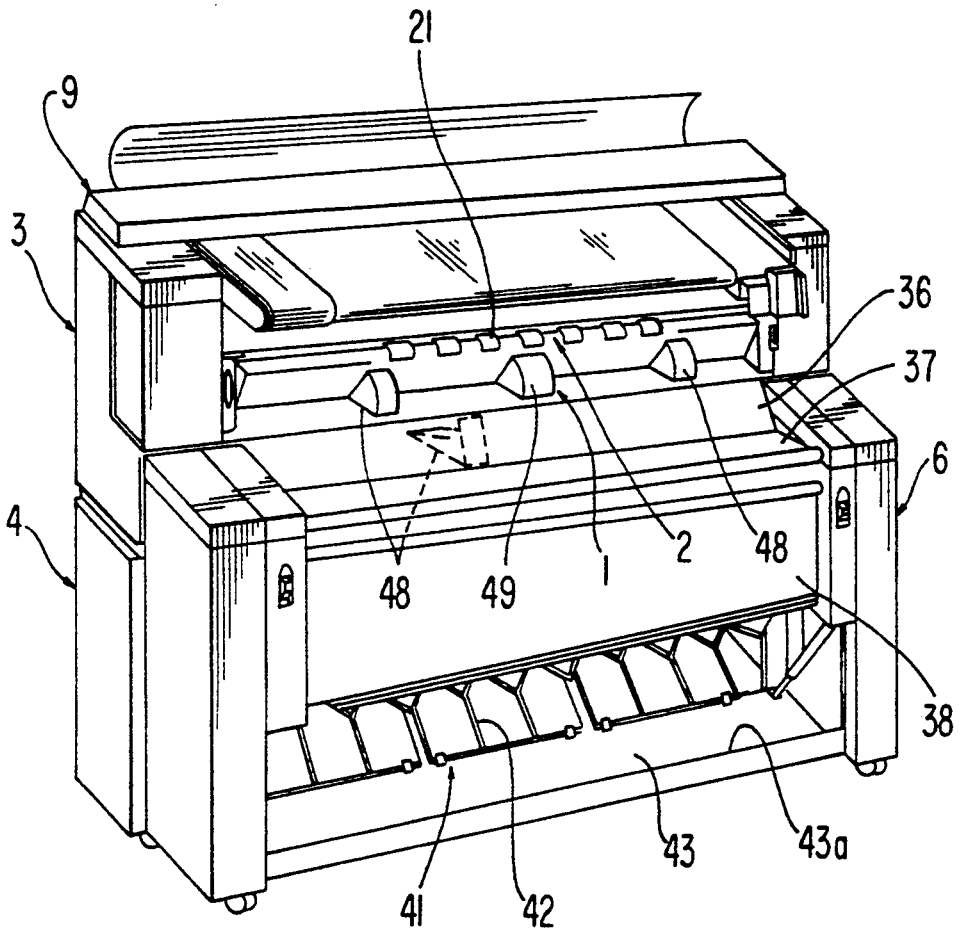
FIG. 1 is a perspective view showing an electrostatic photographic copying machine as one example of an image-forming apparatus according to an embodiment of the present invention.
Figure 2:
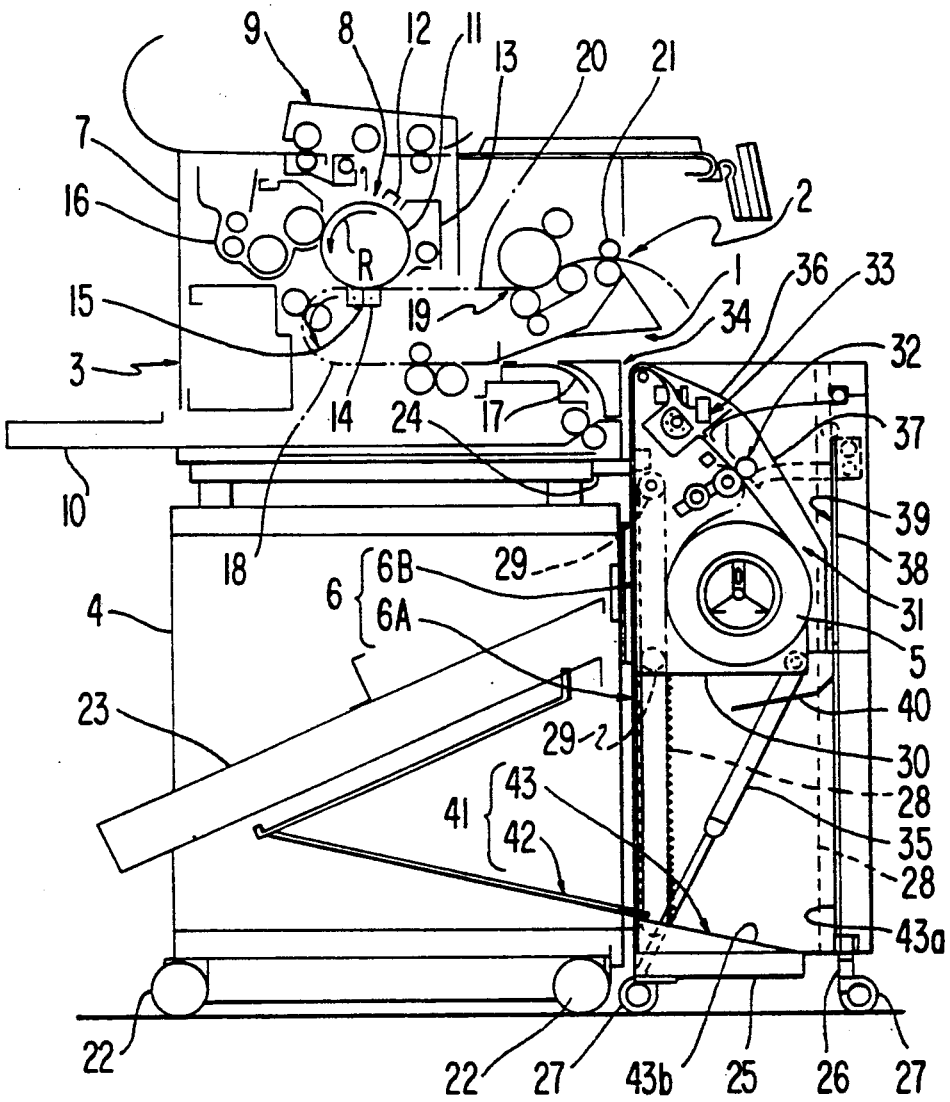
FIG. 2 is a longitudinally sectioned side view showing the electrostatic photographic copying machine shown in FIG. 1.

The preferred embodiments of the present invention will be described below with reference to the drawings.

At first, a preferred embodiment of the present invention will be described with reference to FIGS. 1 to 6.

FIGS. 1 to 4 show an electrostatic photographic copying machine as one example of an image-forming apparatus. This electrostatic photographic copying machine comprises a body of a copying machine 3 (i.e. the body of an image-forming apparatus) provided with a paper discharging port 2 formed above a manual paper supply port 1, a mobile deck 4 for mounting the body of copying machine 3 thereon and a rolled paper supply unit 6 for cutting rolled paper 5 in predetermined lengths and supplying the manual paper supply port 1 of the body of copying machine 3 with the cut rolled paper 5.

The body of the copying machine 3 has the following construction. An apparatus case 7 is provided with a mechanism 9 for reciprocating a manuscript relative to an exposing device 8 in an upper portion thereof. A large-sized paper supply cassette 10 is provided on the side of the lower portion thereof so as to be freely drawn out toward the rolled paper supply unit 6. The apparatus case 7 is provided with a photoreceptor 11 rotating in a direction shown by an arrow R therewithin, with a main charging device 12, the exposing device 8, a developing device 16, a transfer device 15, a separating device 14 and a cleaning device !3 disposed around the photoreceptor 11, in the order described, to form an image-forming portion.

In addition, a paper passing guide 17 is provided extending from a supply portion of the paper supply cassette 10 to the manual paper supply port 1. A paper supply and conveying passage 18 is provided extending from the manual paper supply port 1 to the transfer device 15. Reference numeral 19 designates a fixing device for fixing a transfer paper which has been transferred and separated. A paper discharging and conveying passage 20 is provided between the fixing device 19 and the separating device 14. Reference numeral 21 designates a pair of paper discharging rollers provided at the paper discharging port 2.

The deck 4 is provided with wheels 22 at a lower portion thereof and a cut paper stacking portion 23 inclined so as to raise its front end inside the deck 4.

Figure 3A:
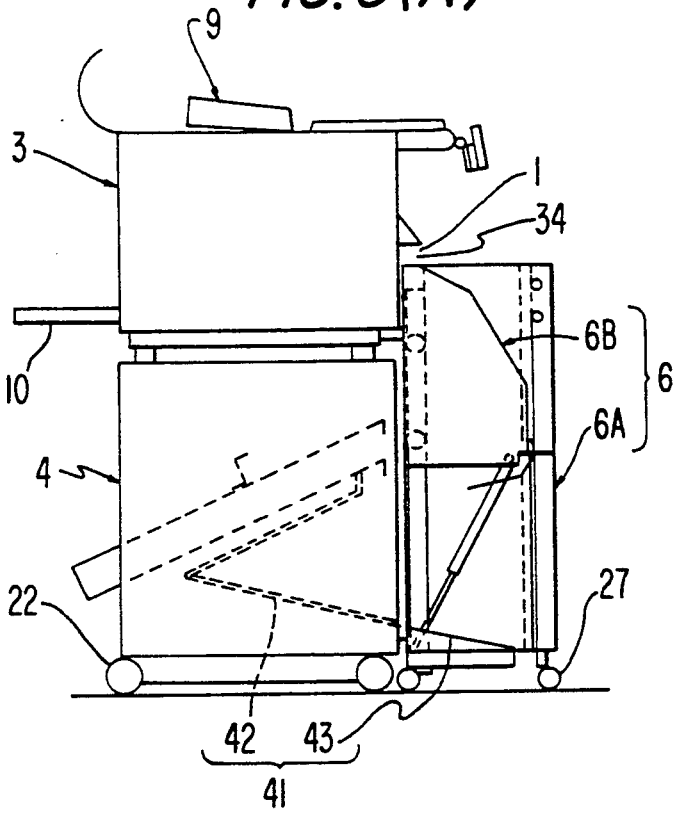
FIGS. 3(A) and (B) are side views describing the operation of a body of a paper supply unit in a rolled paper supply unit.
Figure 3B:
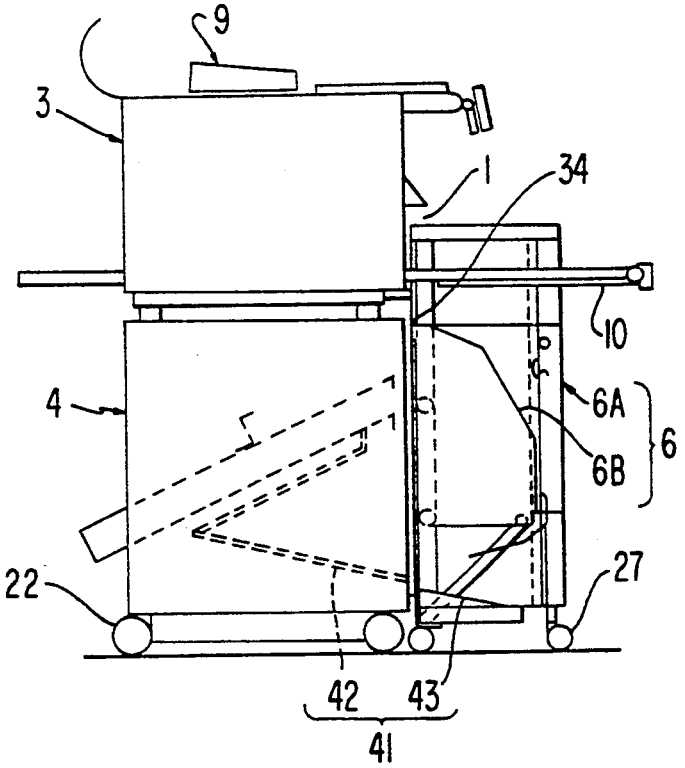

The rolled paper supply unit 6 comprises a unit frame 6A detachably connected with the front side of the body of copying machine 3 through a connecting mechanism 24 and a paper supply unit body 6B elevatable relative to the unit frame 6A. The unit frame 6A is adapted to be movable and adjustable in level by providing wheels 27 through screw shafts 26 directed in an up and down direction at four corners of a lower surface of a bottom frame 25. In addition, guide rails 28 extending in an up and down direction are provided on front and rear sides of longitudinal frames standing on the right and left sides of the bottom frame 25. The paper supply unit body 6B has a charging portion 31 of the rolled paper 5, a pair of paper supply rollers 32 as a rolled paper supply means for drawing out the rolled paper 5 and a cutting mechanism 33 for cutting the drawn out rolled paper 5 in a predetermined length within an elevating frame 30. Pivoting rollers 29 of the elevating frame 30 roll along the guide rails 28, and a rolled paper discharging portion 34 is provided at an upper end of the elevating frame 30. The rolled paper discharging port 34 is adapted to be switched between positions coinciding with the manual paper supply port 1 of the body of copying machine 3 as shown in FIG. 3(A) and a watch-and-wait position shifted downward from the position shown in FIG. 3(A) to the position as shown in FIG. 3(B) by raising and lowering the elevating frame 30. The paper supply cassette 10 may be drawn out, for example to replenish the cassette paper and to clear jamming of the body of copying machine 3, when the rolled paper discharging port 34 is positioned at the watch-and wait position, as shown in FIG. 3(B). Reference numeral 35 designates an energizing means (for example a gas spring) extending from the unit frame 6A to the elevating frame 30 for upwardly biasing the elevating frame 30. Reference numeral 36 designates a tilting guide plate covering an upper portion of the cutting mechanism 33, reference numeral 37 designates a closing cover for covering a front of the charging portion 31, and reference numeral 38 designates a vertical guide plate provided in opposition to the cover 37. The members 36, 37 and 38 form a paper discharging passage 39 extending in the up and down direction for downwardly guiding a paper discharged from the paper discharging port 2 of the body of the copying machine 3 through the front of the paper supply unit body 6B. Reference numeral 40 designates an intermediate guide for guiding the paper from a lower end of the paper discharging passage 39 toward the side of the deck 4. Reference numeral 41 designates a paper discharging tray tilted so as to descend forwardly, and comprises a bent guide member 42 and a bottom tray 43. The paper discharging tray 41 extends from an internal space of the deck 4 to a space under the intermediate guide 40 of the rolled paper supply unit 6.

The bottom tray 43 comprises a tilted portion 43*b* and a riser portion 43*a* positioned at a front end of the tilted portion 43*b*.

Figure 5A:
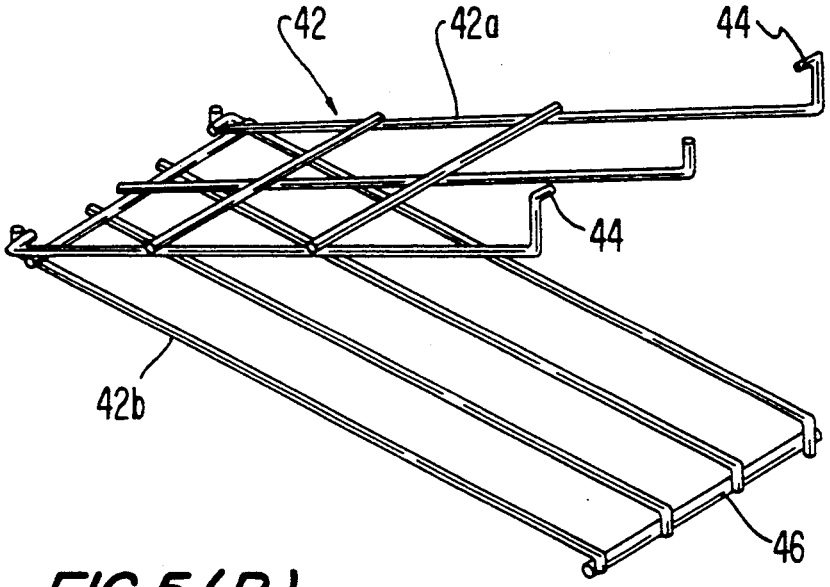
FIGS. 5(A) and (B) are perspective views showing the construction of a bent guide portion.
Figure 5B:
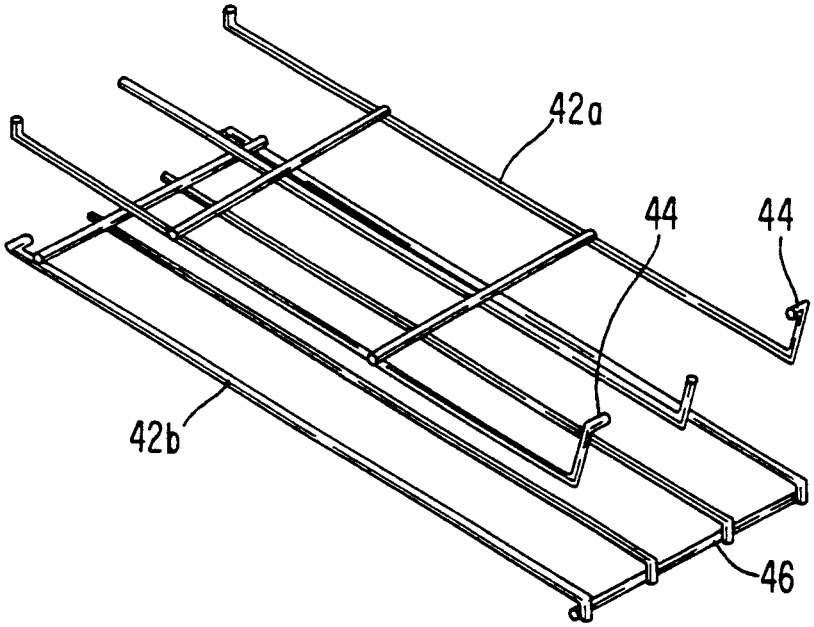
Figure 6:
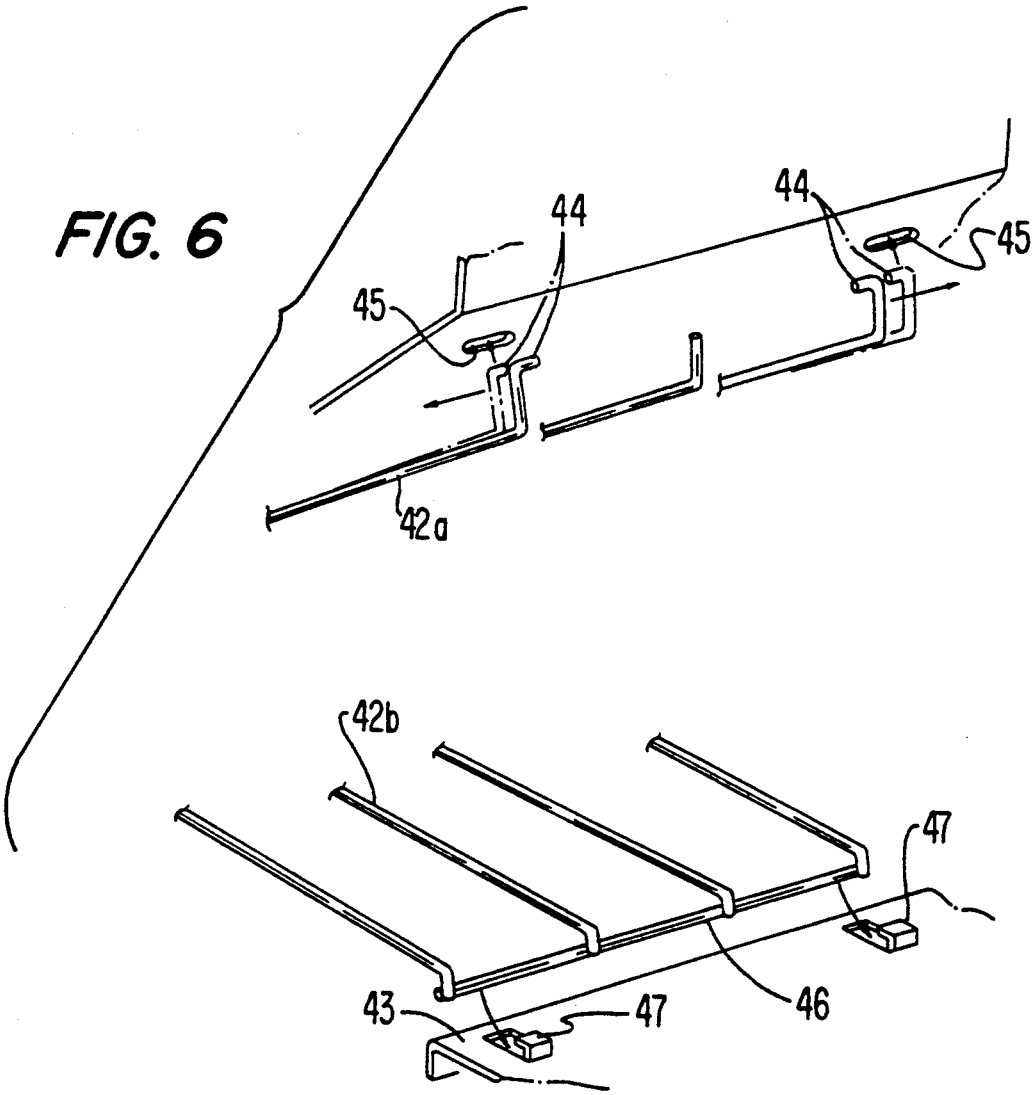
FIG. 6 is a perspective view showing the construction of a fitting portion of the bent guide portion.

The bent guide member 42 comprises a first guide member 42*a* tilted so as to descend rearwardly and a second guide member 42*b* connected at its rear end to a rear lower part of the first guide member 42*a* and tilted so as to descend forwardly. In addition, the first guide member 42*a* constitutes a rearward descending portion while the second guide member 42*b* and the tilted member 43*b* of the bottom tray 43 constitute a forward descending portion. Both the first guide member 42*a* and the second guide member 42*b* are made of a metallic wire material, as shown in FIGS. 5(A) and (B), and FIG. 6. The bent guide member 42 is fixed in position by inserting hooks 44 formed by bending the front ends of the first guide members 42*a* through holes 45 formed in a bottom plate of the cut paper stacking portion 23 from below and engaging a horizontal wire material 46 provided at the front end of the second guide member 42*b* with members 47 provided in the bottom tray 43. In addition, the first guide members 42*a* and the second guide members 42*b* can be taken apart, as shown in FIG. 5(B), when the apparatus is, for example, packed up and transported.

Figure 4:
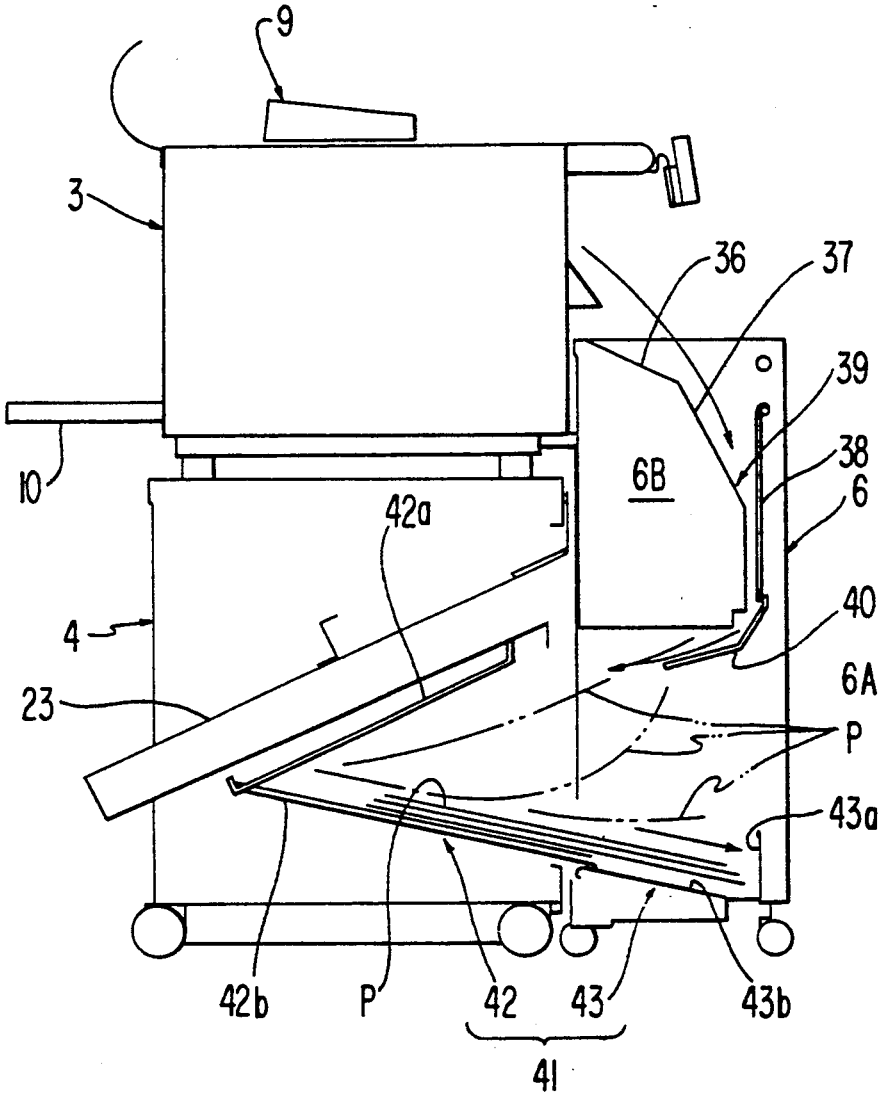
FIG. 4 is a longitudinally sectioned side view describing the behavior of paper.

According to the above described preferred embodiment, as shown in FIG. 4, the paper P discharged from the paper discharging port 2 goes around the front of the paper supply unit body 6B to freely fall through the paper discharging passage 39 extending in the up and down direction. This is followed by bending the path of the paper toward the side of the deck 4 with the intermediate guide 40. The paper P leaves the intermediate guide 40 at a rear end thereof under a condition wherein it is positioned at the bent portion of the bent guide member 42, or at least in the vicinity of the bent portion of the bent guide member 42, at the pointed end thereof, to freely fall on to the paper discharging tray 41 with the rear end of the paper directed upward. The paper P on the paper discharging tray 41 slides down along the inclination of the tray to be stacked on the paper discharging tray 41. The papers P are put in order at the rear ends thereof by the riser portion 43*a* provided at the front end of the paper discharging tray 41.

Accordingly, the stacked paper P can be easily removed from the front of the apparatus.

Referring to FIG. 1, reference numeral 48 designates a plurality of paper supply and discharging guides having a lower surface portion formed as a paper supply guide portion and an upper surface portion formed as a paper discharging guide portion. The guides 48 are provided at intervals in the direction of width of the copying machine 3 between the manual paper supply port 1 and the paper discharging port 2. Detailed construction and operation of the paper supply and discharging guides 48 will be described later. Reference numeral 49 designated a paper discharging guide for guiding the paper P discharged from the paper discharging port 2 to the paper discharging passage 39 at an intermediate portion in the direction of width of the copying machine 3.

In addition, although the first guide members 42*a* and the second guide members 42*b* were made of wire material in the preferred embodiment shown, they may be made of a plate material. Furthermore, the bottom plate of the cut paper stacking portion 23 may also be used as the first guide members 42*a*, i.e. as the forwardly descending portion.

Although the forwardly descending portion of the paper discharging tray 41 shown comprises the bent guide member 42 and the tilted member 43*b* of the bottom tray 43 tilted so as to descend forward, not only may the tilted member 43*b* of the bottom tray 43 be omitted, but the second guide members 42*b* of the bent guide member 42 may be extended forward and downward to a position corresponding to the tilted member 43*b*. In every case, the first guide members 42*a* of the bent guide member 42 can be omitted. In addition, the upper surface of the tilted member 43*b* of the bottom tray 43 connected with the front ends of the second guide members 42*b* may be horizontally arranged. In this case, the horizontal upper surface of the bottom tray 43 is arranged lower than the tilted upper surfaces of the second guide members 42*b* so that the rear end of the paper P may not be caught.

In addition, the upper end of the bent guide member 42 may be mounted on the paper supply unit body 6B and the lower end of the bent guide member 42 may be mounted on the unit frame 6A in the same manner as in the second embodiment, which will be mentioned later.

Furthermore, although the deck 4 is separated from the body of copying machine 3 in the above described preferred embodiment, other preferred embodiments, in which both members 3 and 4 are integrated, for example by providing a common frame or exterior panel extending in the up and down direction, can be thought of.

Next, a second preferred embodiment of the invention will be described with reference to FIGS. 7 to 10 Referring to FIGS. 7 to 10, the same reference numerals as used in FIGS. 1 to 6 designate the same features in FIGS. 7 to 10.

Figure 7:
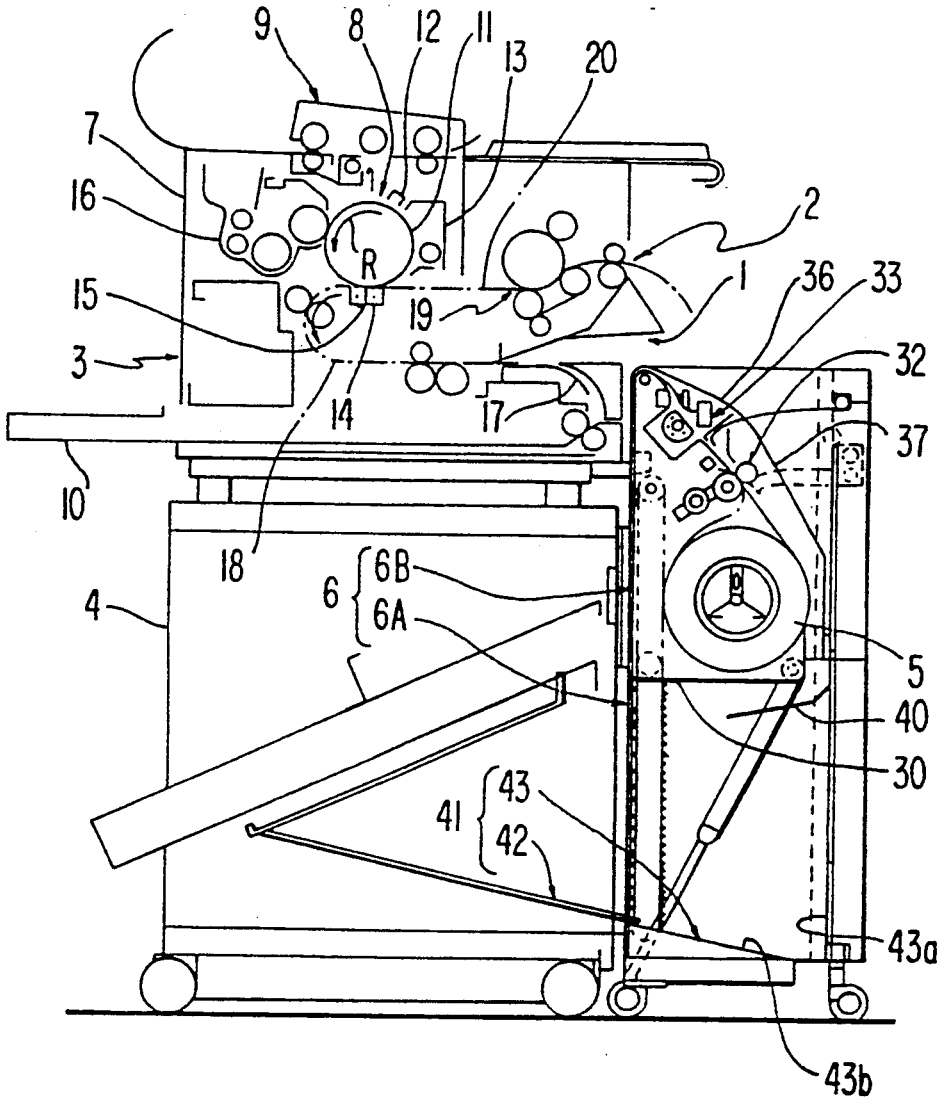
FIG. 7 is a rough longitudinally sectioned side view showing an electrostatic photographic copying machine as one example of an image-forming apparatus according to a variation of the present invention.
Figure 8:
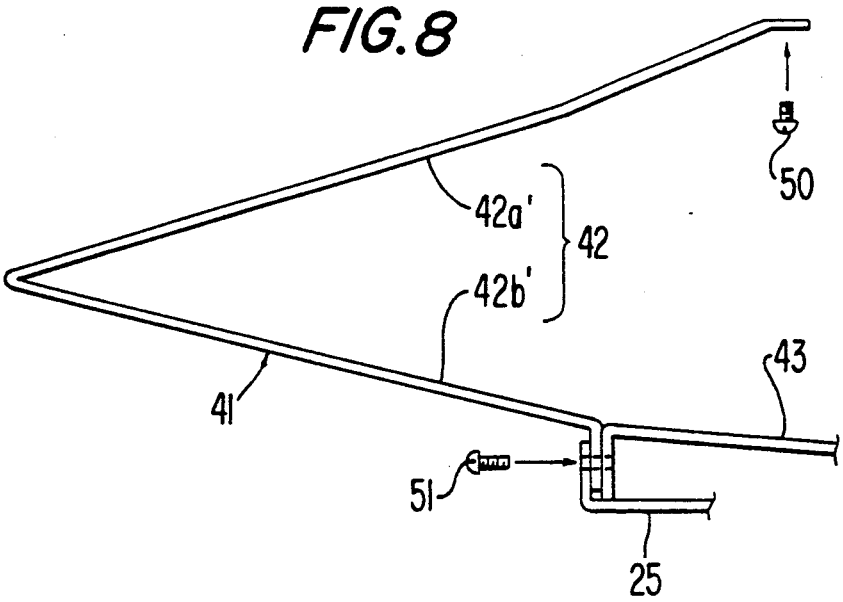
FIG. 8 is a side view showing a part of the apparatus of FIG. 7.

In the second embodiment, the rolled paper supply unit 6 is provided with the paper discharging tray 41 for stacking paper discharged from the paper discharging port 2. As shown in FIGS. 7 and 8, the paper discharging tray 41 is provided with a bent guide member 42 formed in nearly a V letter sectional shape by bending a piece of flat plate made of a light and flexible elastic material, such as plastic corrugated cardboard, in the vicinity of its center. A guide member 42*a* on the upper half of the bent guide member 42 is mounted on a bottom surface of the paper supply unit body 6B of the rolled paper supply unit 6 at an upper end thereof by means of a screw 50 or the like. A guide member 42*b* on the lower half of the bent guide member 42 is put between the bottom frame 25 of the unit frame 6A and one end of the bottom tray 42 at a lower end of the guide member 42*b*. The guide member 42*b* is additionally fixed by means of a screw 51 or the like.

According to this construction, the rolled paper supply unit 6 can be connected with the body of the image-forming apparatus 3 after the paper discharging tray 41 has been mounted on the rolled paper supply unit 6. On the other hand, the paper discharging tray 41 can be removed after the rolled paper supply unit 6 has been removed from the body of the image forming apparatus 3.

Accordingly, the mounting and removal of the paper discharging tray 41 and the assembly of the image forming apparatus can be easily conducted.

Besides, since the bent guide member 42 of the paper discharging tray 41 is formed by bending the flat plate made of the elastic material in nearly a V letter sectional shape, the bent guide member 42 does not hinder the ascent and descent of the paper supply unit body 6B. Further, even though the bent guide member 42 is bent by the ascent and descent of the paper supply unit body 6B, the bent guide member 42 is easily restored to its original state by its elasticity.

Figure 9:
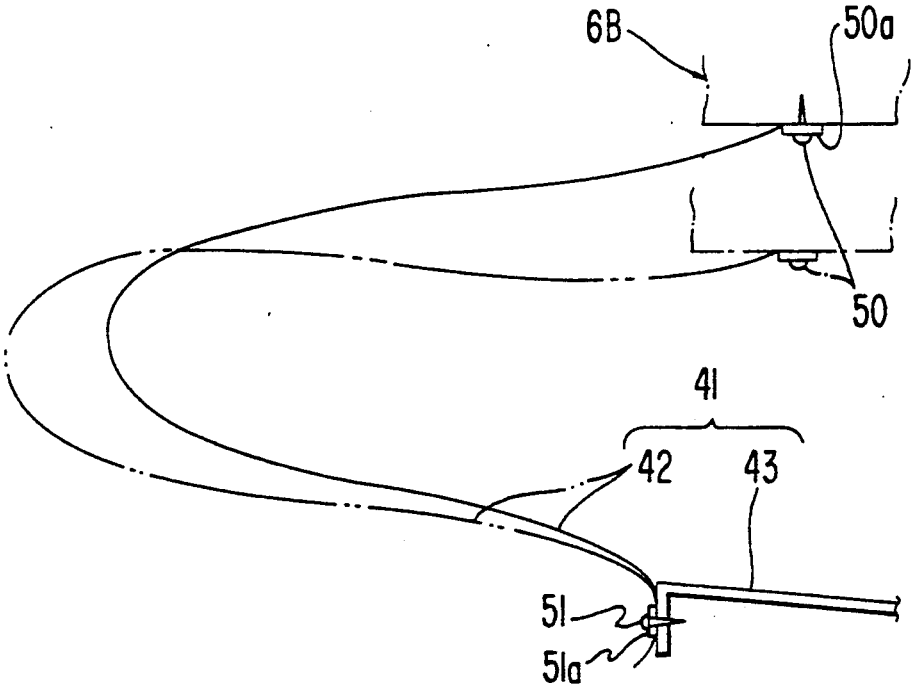
FIG. 9 and 10 are side views showing variations of the part of FIG. 8.
Figure 10:
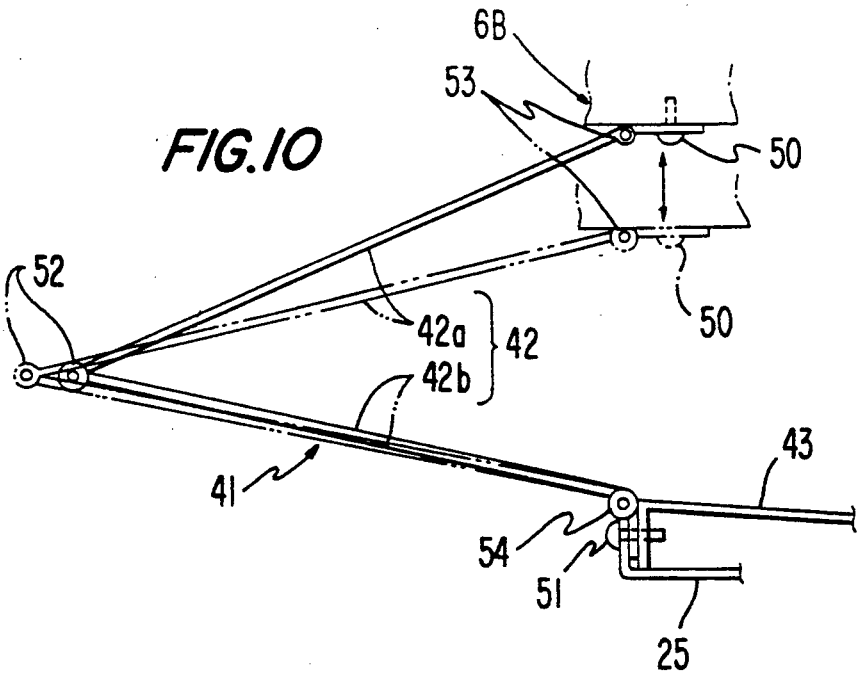

FIG. 9 and FIG. 10 show a variation of the second embodiment of the invention. The embodiment shown in FIG. 9 is characterized in that the bent guide member 42 is formed in nearly a U letter sectional shape from a piece of a synthetic resin sheet (for example a sheet made of vinyl chloride 0.4 mm thick). The preferred embodiment shown in FIG. 10 is characterized in that the bent guide member 42 comprises the first guide member 42*a* tilted so as to descend rearwardly and the second guide member 42*b* tilted so as to descend forwardly and connected with the first guide member 42*a* so as to be pivotable about a horizontal axis shaft line. The bent guide member 42 is formed in nearly a V letter sectional shape.

According to the constructions of FIGS. 9 and 10, the bent guide member 42 is deformed with the ascent and descent of the paper supply unit body 6B, as shown by an imaginary line in FIG. 9 and FIG. 10. The ascent and descent of the paper supply unit body 6B is thus not hindered by the bent guide member 42, and additionally, the mounting and removal of the bent guide member 42 and the assembly of the image-forming apparatus can be easily conducted.

Furthermore, referring to FIG. 9, reference numerals 50*a* and 51*a* designate washers. Two screws 50 and 51, together with the respective washers 50 and 51*a*, affix the ends of the piece of synthetic resin sheet to the paper supply unit body 6B and the bottom tray 43, respectively.

Referring to FIG. 10, reference numeral 52 designates a hinge for connecting the first guide member 42*a* with the second guide member 42*b*. Reference numeral 53 designates a hinge provided on the upper end of the first guide member 42*a* and reference numeral 54 designates a hinge provided on the lower end of the second guide member 42*b*. These hinges 53 and 54 are arranged on the same vertical line, parallel with the hinge 52. The hinges are attached by screws 50 and 51 to the paper supply unit body 6B and the bottom tray 43. The first guide member 42*a* and the second guide member 42*b* are made of a plate material, but they may be made of a wire material.

Next, a further preferred feature of the invention is described with reference to FIGS. 11 to 13. In addition, referring to FIGS. 11 to 13, the same reference numerals as used in FIGS. 1 to 6 designate the same elements in FIGS. 11 to 13.

Figure 11:
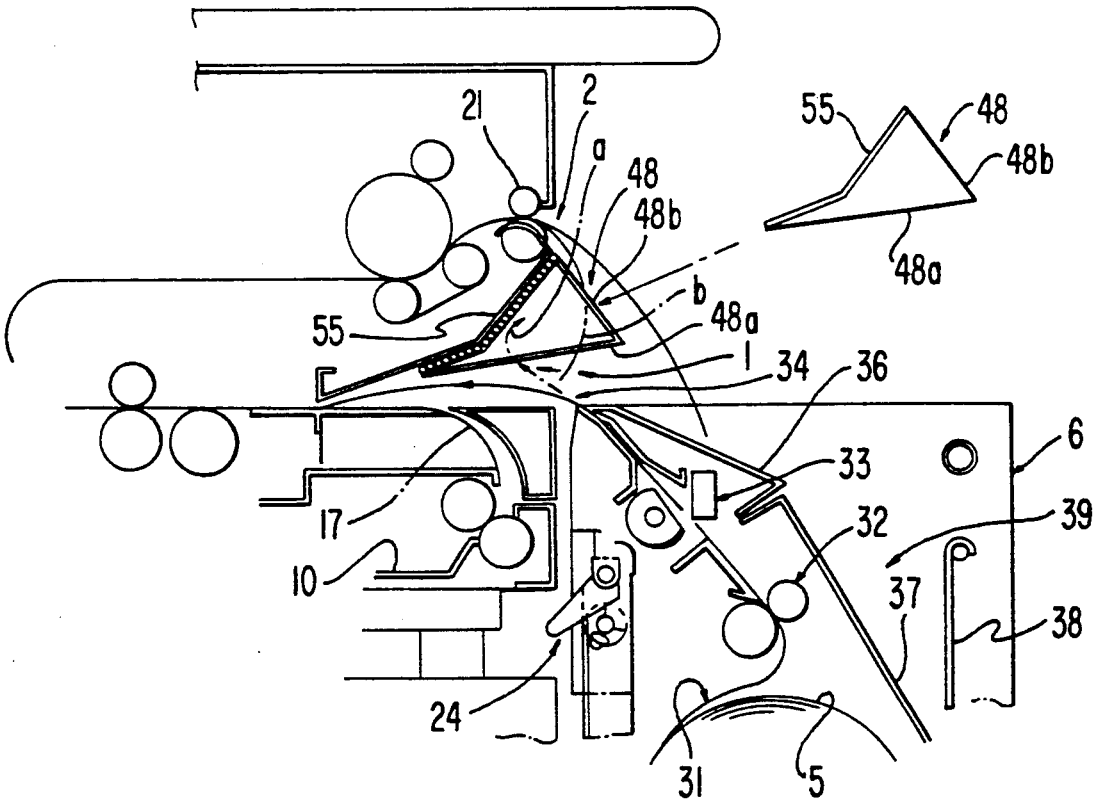
FIG. 11 is a longitudinally sectioned side view showing main parts in an electrostatic photographic copying machine as one example of an image-forming apparatus according to a further feature of the present invention.
Figure 12:
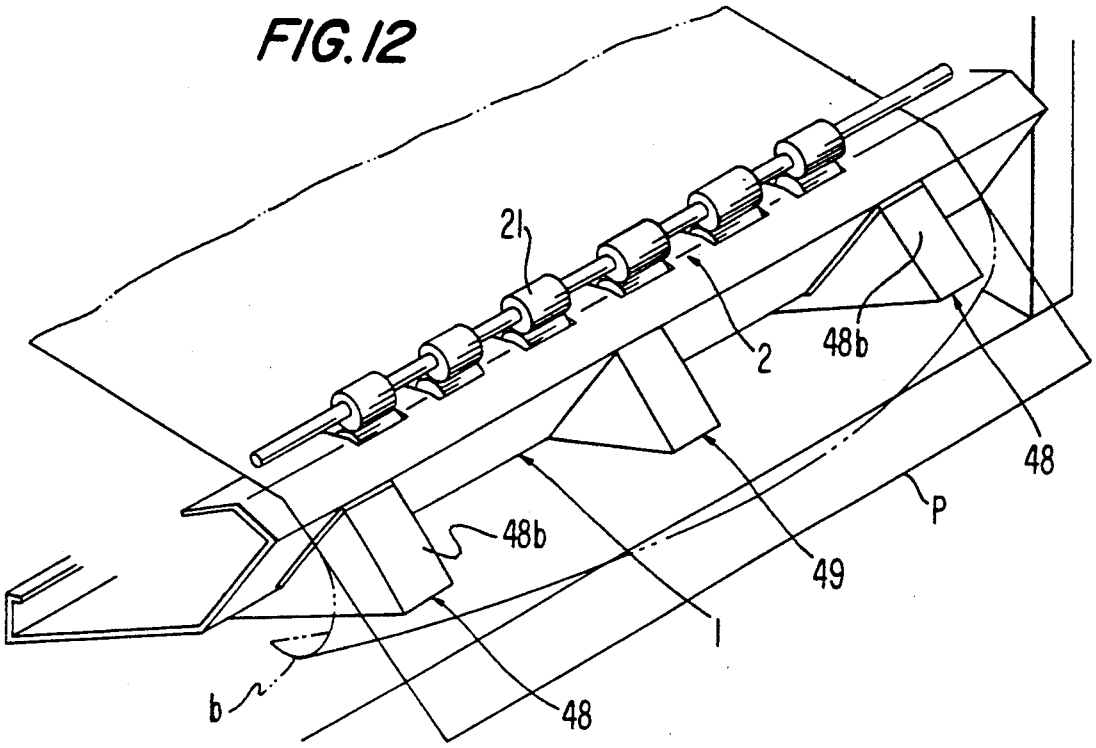
FIGS. 12 and 13 are perspective views of parts of the apparatus of FIG. 11, describing the operation thereof.
Figure 13:
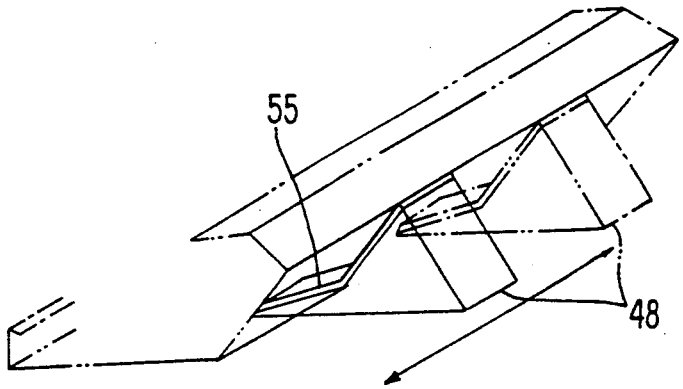

A plurality of paper supply and discharging guides 48 having a lower surface portion formed as a paper supply guide portion 48*a* and an upper surface portion formed as a paper discharging guide portion 48*b* are formed at intervals in the direction of the width of the copy machine 5 between the manual paper supply port 1 and the paper discharging port 2, as shown in FIGS. 11 to 13, in the same image-forming apparatus as described earlier. Both side portions of the rolled paper 5, discharged from the rolled paper discharging port 34, are guided to the inside of the manual paper supply port 1 by the paper supply guide portions 48*a*. The paper P discharged from the paper discharging port 2 is guided to the paper discharging passage 39 by the paper discharging guide portions 48*b* at both side portions of the paper. The paper supply and discharging guides 48 are mounted on the side of the body of the copying machine 3 by permanent magnets 55, such as rubber magnets. The guides 48 are thus fixedly mounted so as to be changeable in mounting position depending upon the width of the rolled paper 5, as shown in FIG. 13.

According to the above described construction, a cassette paper supplied from the paper supply cassette 10 and the rolled paper 5, which has been supplied through the manual paper supply port 1 from a rolled paper supply unit 6 and then cut at a predetermined time, are discharged from the paper discharging port 2 after an image-transferring process and a fixing process.

When the rolled paper 5 is supplied by the rolled paper supply unit 6, even through corner portions on both sides of a pointed end of the rolled paper 5 are curled upward on account of the curling property incidental to the rolled paper 5, as shown by an imaginary line (a) in FIG. 11, these curled portions are guided by the lower surfaces of the paper supply and discharging guides 48, formed as the paper supply guide portions 48*a*, to be smoothly supplied to the inside of the manual paper supply port 1, and thus the curled portions can be prevented from being bent.

In addition, even though corner portions on both sides of the paper P (the rolled paper cut in a predetermined length) which has been discharged from the paper discharging port 2 are curled downward, as shown by an imaginary line (b) in FIG. 11 and FIG. 12, the paper P is guided to the paper discharging passage 39 by the upper surfaces of the paper supply and discharging guides 48, formed as the paper discharging guide portions 48*b*, to be prevented from entering the manual paper supply port 1, i.e. from being resupplied and reprocessed.

As described above, according to the present invention, effects occur in that, for example, paper which has been discharged from the paper discharging port above the manual paper supply port can be stacked on the paper discharging tray so as to be easily removed from the front of the apparatus. The mounting and removal of the paper discharging tray and the assembly of the image forming apparatus can be easily conducted. Additionally, the phenomenon wherein corner portions on both sides of the paper are bent when the paper is supplied, and the phenomenon wherein the paper is resupplied when the paper is discharged from the paper discharging port above the paper supply port, can be prevented from occurring by the simple construction wherein a number of the members having the upper surface and the lower surface of the paper supply and discharging guides as the paper discharging guide portion and the paper supply guide portion, respectively, can be reduced.

What is claimed is:

1. An image-forming apparatus, comprising:

an image-forming apparatus body having image forming means for forming an image on paper passing therethrough;

a manual paper supply port on a front side of said image-forming apparatus body for supplying paper to said image forming means;

a paper discharging port on the front side of said image-forming apparatus body for discharging paper after an image has been formed thereon by said image forming means, said paper discharging port being located above said manual paper supply port;

a deck having said image-forming apparatus body mounted thereon, said deck defining an internal space below said image-forming apparatus body;

a passage means defining a paper discharging passage that extends in a vertical direction for passing paper from said paper discharging port around the front side of said image-forming apparatus body and guiding the paper downward; and a paper discharging tray extending in said internal space of said deck below said paper discharging passage for receiving paper discharged from said paper discharging port and passed and guided by said paper discharging passage.

2. The apparatus of claim 1, and further comprising a rolled paper supply unit for supplying paper from a roll to said manual paper supply port disposed in front of said image-forming apparatus body, said paper discharging passage passing through the inside of said rolled paper supply unit.

3. The apparatus of claim 2, wherein said rolled paper supply unit has a body with a rear portion adjacent said image-forming apparatus body and said deck and a front portion, said front portion having said paper discharging passage extending therethrough.

4. The apparatus of claim 2, wherein said rolled paper supply unit has an intermediate guide therein for guiding paper from a lower end of said paper discharging passage to a front side of said deck.

5. The apparatus of claim 1, wherein said paper discharging tray comprises an inclined portion descending forwardly from its rear end toward its front end and a riser portion located at the front end of said inclined portion.

6. The apparatus of claim 5, wherein said paper discharging tray further comprises a second inclined portion descending rearwardly to the rear end of the first said inclined portion.

7. The apparatus of claim 6, wherein the second said inclined portion is a first guide member for guiding paper from said paper discharging passage, the first said inclined portion is a second guide member for guiding paper from said paper discharging passage, and said first and second guide members are connected, forming a bent guide member.

8. The apparatus of claim 7, wherein said first and second guide members are made of a wire material.

9. The apparatus of claim 5, wherein said inclined portion descends continuously forward until said riser portion.

10. The apparatus of claim 1, and further comprising:

a rolled paper supply unit for supplying paper from a roll to said manual paper supply port disposed in front of said image-forming apparatus body, said unit comprising a unit frame connected to said image-forming apparatus body and a rolled paper supply unit body mounted on said unit frame for ascending and descending movement relative to said unit frame;

wherein said paper discharging tray is provided with a bent guide member for guiding paper from said paper discharging passage to said paper discharging tray, said bent guide member having an upper end connected to said rolled paper supply unit body and a lower end connected to said unit frame.

11. The apparatus of claim 1, wherein a plurality of paper supply and discharging guides are spaced at intervals along the width of said image-forming apparatus body between said manual paper supply port and said paper discharging port, said guides having a lower surface forming a paper supply guide portion for guiding paper supplied to said manual paper supply port therein and an upper surface forming a paper discharging guide portion for guiding paper discharged by said paper discharging port.

12. An image-forming apparatus, comprising:

an image-forming apparatus body having image forming means for forming an image on paper passing therethrough;

a manual paper supply port on a front side of said image-forming apparatus body for supplying paper to said image forming means;

a paper discharging port on the front side of said image-forming apparatus body for discharging paper after an image has been forming thereon by said image forming means, said paper discharging port being located above said manual paper supply port;

a rolled paper supply unit for supplying paper from a roll to said manual paper supply port disposed in front of said image-forming apparatus body, wherein said rolled paper supply unit is provided with a paper discharging tray for receiving and stacking papers discharged from said paper discharging port.

13. The apparatus of claim 12, wherein:

said rolled paper supply unit comprises a unit frame connected to said image-forming apparatus body and a rolled paper supply unit body mounted on said unit frame for ascending and descending movement relative to said unit frame; and said paper discharging tray is provided with a bent guide member for guiding paper from a paper discharging passage to said tray, paper discharging bent guide member having an upper end connected to said rolled paper supply unit body and a lower end connected to said unit frame.

14. The apparatus of claim 13, wherein said rolled paper supply unit comprises a passage means therein defining a paper discharging passage that extends in the vertical direction for passing paper from said paper discharging port and guiding the paper downward.

15. The apparatus of claim 14, wherein said rolled paper supply unit body has a rear portion adjacent said image-forming apparatus body and a front portion, said front portion having said paper discharging passage extending therethrough.

16. The apparatus of claim 13, wherein said bent guide member has a bent portion located in a space defined below said image-forming apparatus body.

17. The apparatus of claim 16, wherein said image-forming apparatus body has a deck supporting said image-forming apparatus body and said deck defines said space, internally thereof, wherein said bent portion of said bent guide is located.

18. The apparatus of claim 16, wherein said rolled paper supply unit comprises a passage means therein defining a paper discharging passage that extends in a vertical direction for passing paper from said paper discharging port and guiding the paper downward and an intermediate guide for guiding paper from a lower end of said paper discharging passage toward said bent portion of said bent guide member.

19. The apparatus of claim 16, wherein said bent guide member is a flat plate made of an elastic material and bent into substantially a V-shape.

20. The apparatus of claim 16, wherein said bent guide member is a piece of a synthetic resin sheet in a substantially U-shape.

21. The apparatus of claim 16, wherein said bent guide member comprises a first guide member inclined so as to descent rearwardly and a second guide member inclined so as to descend forwardly, said first and second guide members being connected together so as to be pivotable relative to each other about a horizontal axis and so as to form a substantially V-shape.

22. The apparatus of claim 13, wherein a plurality of paper supply and discharging guides are spaced at intervals along the width of said image-forming apparatus body between said manual paper supply port and said paper discharging port, said guides having a lower surface forming a paper supply guide portion for guiding paper supplied to said manual paper supply port therein and an upper surface forming a paper discharging guide portion for guiding paper discharged by said paper discharging port.

23. An image-forming apparatus, comprising:

an image-forming apparatus body having image forming means for forming an image on paper passing therethrough;

a manual paper supply port on a front side of said image-forming apparatus body for supplying paper to said image forming means;

a paper discharging port on the front side of said image-forming apparatus body for discharging paper after an image has been formed thereon by said image forming means, said paper discharging port being located above said manual paper supply; and a plurality of paper supply and discharging guides are spaced at intervals along the width of said image-forming apparatus body between said manual paper supply port and said paper discharging port, said guides having a lower surface forming a paper supply guide portion for guiding paper supplied to said manual paper supply port therein and an upper surface forming a paper discharging guide portion for guiding paper discharged by said paper discharging port.

24. The apparatus of claim 23, and further comprising a rolled paper supply unit for supplying paper from a roll to said manual paper supply port mounted to said image forming apparatus body, said rolled paper supply unit comprising a rolled paper charging portion, a rolled paper supply means for drawing out rolled paper adjacent thereto, a cutting means for cutting the drawn out rolled paper in a predetermined length and a rolled paper discharge port for discharging the rolled paper in the predetermined length, wherein means are provided for switching said rolled paper discharge port between a first position coincident with said manual paper supply port and a wait 25. The apparatus of claim 23, wherein said paper supply and discharging guides are movably mounted on said image forming apparatus body for movement along the width thereof.

* * * * *